US010428634B2

(12) United States Patent
Kinley et al.

(10) Patent No.: US 10,428,634 B2
(45) Date of Patent: Oct. 1, 2019

(54) WATER JET MINING SYSTEM AND METHOD

(71) Applicant: Islander, LLC, Overland Park, KS (US)

(72) Inventors: Colin B. Kinley, Leawood, KS (US); Andrew Mac Ewen, Leawood, KS (US)

(73) Assignee: Islander, LLC, Overland Park, KS (US)

( * ) Notice: Subject to any disclaimer, the term of this patent is extended or adjusted under 35 U.S.C. 154(b) by 0 days.

(21) Appl. No.: 15/282,403

(22) Filed: Sep. 30, 2016

(65) Prior Publication Data

US 2017/0089199 A1 Mar. 30, 2017

Related U.S. Application Data

(60) Provisional application No. 62/235,310, filed on Sep. 30, 2015.

(51) Int. Cl.
*E21B 43/29* (2006.01)
*E21B 21/12* (2006.01)

(52) U.S. Cl.
CPC ..... *E21B 43/29* (2013.01); *E21B 21/12* (2013.01)

(58) Field of Classification Search
CPC . E21B 43/29; E21B 21/12; E21B 7/18; E21B 17/18
See application file for complete search history.

(56) References Cited

U.S. PATENT DOCUMENTS 3,797,590 A * 3/1974 Archibald ..... E21B 7/18 175/213
4,134,619 A * 1/1979 Bunnelle ..... E21B 21/10 175/215
4,296,970 A * 10/1981 Hodges ..... E21B 7/18 175/213
4,401,345 A * 8/1983 Archibald ..... E21B 43/29 175/213
4,915,452 A * 4/1990 Dibble ..... E21B 43/29 175/216
5,186,266 A * 2/1993 Heller ..... E21B 10/04 175/215
5,529,084 A * 6/1996 Mutsakis ..... F15D 1/04 137/13
6,460,936 B1 * 10/2002 Abramov ..... E21B 21/12 175/40

(Continued)

*Primary Examiner* — Carib A Oquendo
(74) *Attorney, Agent, or Firm* — Glenn H. Lenzen; Dietze and Davis, P.C.

(57) ABSTRACT

A water jet borehole mining system controlled and operated aboveground includes a high-pressure cutting nozzle that is delivered to an underground resource body through a relatively small diameter borehole. A series of water and air streams at various pressures are delivered to the resource body, and the target resource is disaggregated and/or fluidized and conveyed back to surface via the water jet borehole mining pipe which serves as the conveyor of the system. The mining pipe is used to transport a high-pressure stream of water fluids that have been directed and aligned into laminar flow to a focused water jet cutting head. The central bore of the mining pipe brings the disaggregated and slurrified resource to the surface. The mining pipe transports the slurry via airlift, fluid eduction or a combination of both.

18 Claims, 8 Drawing Sheets

(56) References Cited

U.S. PATENT DOCUMENTS

| | | | | |
|---|---|---|---|---|
| 7,090,153 | B2 * | 8/2006 | King | B05B 1/20 166/177.5 |
| 2005/0284664 | A1 * | 12/2005 | Riel | E21B 7/068 175/57 |
| 2013/0181438 | A1 * | 7/2013 | Syse | E21B 17/18 285/123.3 |
| 2014/0190751 | A1 * | 7/2014 | Vestavik | E21B 21/12 175/65 |
| 2015/0107905 | A1 * | 4/2015 | Kinley | E21B 43/29 175/57 |

* cited by examiner

WATER JET MINING SYSTEM AND METHOD

CROSS-REFERENCE TO RELATED APPLICATIONS

This application claims the benefit of U.S. Provisional Patent Application Ser. No. 62/235,310, filed on Sep. 30, 2015, and entitled WATER JET MINING SYSTEM AND METHOD, which is incorporated herein by reference.

FIELD OF THE INVENTION

The present application relates to the field of subterranean water jet/hydraulic borehole mining. More specifically, the present invention relates to a new and novel high pressure system and method to perform economic, high production, continuous commercial mining by water jet borehole mining within a target ore body either in fully submerged conditions below the water table or under full atmospheric conditions.

BACKGROUND OF THE INVENTION

In situ hydraulic borehole mining equipment and techniques are known in the art and are the subject of patents that disclose systems for the mining of uranium, phosphate and heavy oil resource bodies, such as U.S. Pat. No. 4,915,452 issued to Dibble; U.S. Pat. No. 4,296,970 issued to Hodges; and U.S. Pat. No. 4,348,058 issued to Coakley et al. However, the mining systems and methods in these representative disclosures do not effectively address the fluid dynamics associated with maximizing effective jet horsepower, do not provide an economical alternative for mining in an isolated flooded environment, and do not effectively address the ability to efficiently lift a subterranean resource to the surface. More specifically, these prior patents disclose equipment systems designed solely to lift ore back to the surface by the use of a high-pressure eduction system. Notwithstanding the advances made by these inventions, to date, no prior art hydraulic mining system has attained commercial success of the shortcomings being attributable to the ineffective and inefficient utilization of fluids and the sub-optimization of the mining extraction processs. Prior art systems do not fully integrate the critical components of water jet borehole mining to optimize reach and production rates on the one hand and to minimize energy consumption on the other. Thus, continual economically justifiable and sustainable commercial production rates have not been achieved, and the operating costs of prior art borehole mining systems are too high to effectively replace conventional commercial mining systems and techniques.

In addition to the foregoing, the very mining pipe associated with prior art mining systems is the source of frustrating and costly operational problems. The threaded portions used to couple various sections of the mining pipe are prone to galling and eventually become unusable. In a threaded connection with multiple telescoping pipes, several sets of threads must be properly aligned in order to make up the mining string. Even with small misalignments, threads become galled, rendering a piece of mining pipe unusable. With the three concentric parallel strings of the subject invention, the pipe is aligned and threaded together with only one pipe, preferably, the outermost pipe, while the other two pipes employ tapered coupling or connecting portions, which self-align, virtually eliminating any chance of damaging the mining pipe sections. With the threaded connections and tapered internal pipes of the system invention, the problem of galling of threads is eliminated, inasmuch as the threads interconnecting all but the outermost section have been eliminated.

Another problem associated with prior art mining systems is the tendency of the systems to collect oversized particles in the bottom of the mining cavity. These particles clog up the system. When the system becomes blocked, advancement stops, requiring tripping out of the hole and drilling the rock fragments up by conventional methods. This interruption, which is eliminated by the system disclosed herein, severely affects operating economics and completely stops advancement under block caving conditions.

Water jet borehole mining has several advantages over conventional mining techniques. One of the key attributes exploited through the borehole mining technique is the ability to selectively target and mine high-grade resources. With water jet borehole mining, the highest-grade section of the resources can be selectively mined while leaving the remaining lower grade resources in place. With traditional mining techniques, the overburden is removed or worked around in order to access the targeted resource. The usual expense and dilution of the economics of the project can render the project economically unfeasible. The use of the subject invention and associated techniques allows a small borehole to be drilled into the resource body, thereby permitting the target ore to be efficiently and economically mined and moved to surface without disturbing the overburden. Non-turbid lamination of the water flow to the jet is one component of the subject invention in terms of ultimate production and reach of the jet in the cavern in both atmospheric and submerged conditions.

The environmental impact of an underground hydraulic borehole mining process is exponentially less than that of a conventional open pit mining application. Highly mobile equipment deployable at any angle on commercially available modern drilling rigs allows high accessibility to horizontal surface based, high slope and marine based applications. Small-scale equipment used in the process minimizes site impact and decreases mining risk of groundwater and surface contamination by cased isolation of the mining system and effective protection of groundwater. Leaching of resources such as uranium or contaminated fluids or acids such as those generated through oil sands or heavy minerals mining is minimized, if not completely eliminated. A unique aspect of the system herein disclosed is that, compared to prior art systems, it can operate both in a fully submerged state and in an atmospheric state. Operating in an atmospheric state extends the reach in certain geology by increasing net delivered horsepower at the rock face.

In some cases, total elimination of open pit access allows safe access to the resource. The effective mining of the resource can allow stripping the target components within the ore, such as the ablation of U308 particles from sandstone or stripping target minerals from mineral sands and the corresponding reinjection of the waste tails in situ by blended sealing with cementitious grout. Effectively, remediation costs and requirements are significantly reduced, less overburden is moved, less in situ groundwater is affected, less surface impact is created and the carbon footprint of mining operations using the invention is greatly reduced compared to conventional mining operations or prior art hydraulic borehole mining technology. Personnel head count can be reduced and exposure to high-risk ore such as uranium can be greatly reduced by effective and economic commercial hydraulic borehole mining. It is not necessary to expose personnel to radiation risk underground. Moreover, the invention provides closed loop fluid circulation, thereby limiting oxygenation of the resource, and reducing environmental exposure of radiation, salt water and acid onto the surface and in situ mining sector.

Within the United States and in multiple countries around the world a vast inventory of projects exist that have either reached the end of their known economic mining life, or that cannot be initiated into production due to unachievable economics or operational or technical inaccessibility. This invention with the complete modernization of new, conceptual and proven hydraulic engineering components will provide a new opportunity to reestablish prior mined resource areas, to create new jobs by economic resource creation and to enrich both private industry and government owned resource bases. Further, this invention will allow the establishment of a new realm of mining potential in environmentally sensitive areas which are not accessible currently because of destructive surface mining or risk of exposure to undesirable mining circumstances. Additionally, the mobility and accessibility of this invention allows the resource owner to target smaller reserves with more discerning accuracy of mining, thereby increasing established resource and reducing capital and regional impact.

Resource body types exist that are not currently available, such as metallurgical coal seams in steeply dipping planes along the environmentally sensitive slope of the Rockies, the steep hills of Appalachia, and the ultra-heavy oil reserves of west Texas and California. The shale oil reserves on the Eastern Rockies slopes are sub-economic to conventional mining. The deep in situ uranium deposits in New Mexico, Colorado and Texas and the kaolin and phosphate deposits of the Southeastern states all have development, reserve and resource potential beneficial to private industry and government with the effective deployment of this system and apparatus. The Kimberlite reserves of Saskatchewan, Canada cannot be developed with conventional mining methods, yet exist as the largest Kimberlite reserves in the world. Kimberlite pipes which only allow fractional accessibility through conventional mining, Kimberlite and Lamprolite pipes in Australia and South Africa that have reached economic limit because dewatering costs are too high or the size of the pipes and the incline of the hanging walls are too steep for conventional mining, all may be accessed by the system and methods herein disclosed. The same may be said of millions of tons of other known resources that cannot be mined or declared as economic reserves because the ore is inaccessible due to high water tables and or excessively steep access ramps. This invention allows the resource owner to drill deep into pipes and target high-grade ores and minerals selectively and, under certain conditions, up to depths never achievable with conventional mining techniques. Offshore mining of granular resources such as tin can be in situations where conventional dredges cannot access the resource through deep overburden. Technical accessibility to otherwise unavailable resources with the system of the present invention significantly enhances mining potential while simultaneously offering low surface and environmental disturbance.

In the hydrocarbon resource sector, the system allows further development of oil shales, oil sands, oil rock and gas shales by cavity creation. Cavity creation allows significant opening of the natural fractures of the rock and may be used as a replacement to hydraulic fracturing or "fracking." This advancement alone may have a significant impact on the conventional oil industry in areas where fracking creates potential for disturbance or is completely banned.

The nature of the system allows the operator to excavate the oil in situ and transport the oil bearing rock to the surface. The subject invention will allow unique access to depleting fields that have significant quantities of oil not currently economically recoverable with known technology. The mining system of the present invention could be used in countries where fracking is completely banned and as a substitute where shallow heavy oil deposits exist.

SUMMARY OF THE INVENTION

The subject invention provides an economic mining alternative to the energy consumption and fluid requirements of the prior art mining technology employing sole eduction systems by utilizing hydraulic airlift and/or eductor system technology to lift the resource to the surface through the vertical lift section. The configuration of the mining pipe of the present invention includes at least two concentric annular rings or pipes structured and arranged to selectively deliver air, high pressure water and low pressure water to the extraction site. The mining pipe system further includes an inner bore reverse circulation system differential which allows an operator to inject a small amount of low pressure air into the return fluid column, reducing its density and creating a vacuum at the system inlet to efficiently lift most resources to surface.

When compared to prior art stand-alone eductors, the airlift system of the subject invention can operate very efficiently with very limited energy. The reduced horsepower and diesel consumption during operation of the mining system of the present invention creates dramatic capital and operating cost savings.

The eduction system is an effective method to return the slurry to the surface. In some conditions such as with horizontal mining, eduction works in conjunction with the other components of the mining system. However, as a stand-alone method of lifting, the energy requirements are very high and need a very high ratio of fluid and pressure be circulated to the bottom of the well bore to educt the disaggregated resource material back to surface. The subject invention addresses this and other problems associated with prior art systems by being designed to work while jetting in atmospheric conditions or in submerged conditions. The eduction built into the system is provided and allows access to long horizontal resource beds from the surface by providing a low pressure fluid eductor at the inlet of the miner to push the slurry coaxially through the horizontal section of the mining pipe and up into the vertical section of the well bore through to the surface with the ability to use the hydraulic airlift at that point to help boost the fluid the rest of the way to the surface through differential hydraulic pressure.

The pipe connections within the system herein disclosed address the galling problems noted above and are critical and unique to the system. The high-pressure fluid streams have no tolerance for leakage. The jetting connections operate at extremely high pressures (up to 8,000 psi) and the fluid must remain fully, safely and properly sealed for the entire length of the mining system. A pressure or fluid loss at a connection is intolerable due to the safety risk at high pressures and the critical need to control jet volumes and consistent delivery pressure at the outlet. The system design overcomes this by using the middle section of the pipe to carry the high-pressure cutting fluid. Accordingly the outer pipe acts as a protective sleeve.

More particularly, the method of the subject invention involves economically mining subterranean resource in situ comprising the steps of drilling a surface hole into subsurface material to access the target resource, injecting high pressure fluid via a borehole mining tool into the resource thereby forming a jet to disaggregate the subsurface material creating a slurry of solids and fluid, injecting a low pressure water stream for eduction to mix with and transport the slurry, injecting low pressure air into the slurry return line to create suction via differential pressure whereby the slurry is lifted to the surface, separating solids and fluid at the surface and recycling the fluid for reuse in the method.

The novel system herein disclosed comprises a borehole mining system including at least one multi-conductor high pressure swivel for redirecting high jet pressure fluid and lower pressure eduction fluid in separate sections through the system. The swivel is adapted to pass a generated slurry though a center bore and to redirect the generated slurry at the surface. The system further includes an inner tube for injection of air to assist the return of the slurry to the surface, a lamination device within the mining pipe for placing the high pressure water into laminar flow, a monitor pipe that maintains the laminar flow of the fluid into the quartic-straight jet nozzle, an eductor system for mixing and returning the slurry to the surface, a plurality of internal flush connection subs joining the high pressure section, and a turning section including a plurality of splitter vanes for maintaining the laminar flow of the water during the turn into a jet nozzle.

The mining system herein disclosed operates at the torque and stress level required for drilling operations while mining. This feature allows an operator to progress the well without removing the mining system, a distinct advantage over prior systems that had to be first removed from the well to progress it. The inlet up the side wall of the monitor allows the continuous mining of soft formation caving, ores, such as mineral sands, and also advancement of the wall.

Depending upon site requirements, the system of the present invention may be configured to align at least two circular ring high-pressure fluid and/or air supply lines from the pumps at surface; although more circular ring supply bins may be used as needed. The aligned fluid flows travel in parallel to a point in the mining pipe where they are introduced to laminar flow chambers created by sectionalized vanes that align the fluid into laminar flow. The current invention utilizes replaceable and serviceable blade or vane sections that may be quickly and economically repaired for ongoing operations. The vanes become damaged over time by the passing of fluid over them, they may be removed by unbolting the housing and replacing them. Prior art designs often resulted in a pipe split which had to be welded back together or which was otherwise unserviceable and disposable. The laminar flow pipes connect to the mining head itself.

The plumbing configuration maintains the laminar flow to the delivery section of the miner where the fluid exits the jet nozzle. The system of the subject invention maintains the alignment of the laminated flow in order to maximize the distance and the effectiveness of the jet by means of inset replaceable x-vanes that turn the high-pressure high volume laminar flow while minimizing turbidity and tortuosity.

The hydraulic borehole mining process of the subject invention can be summarized as follows: drilling a suitably sized hole to convey the borehole mining system to the top of the resources to be mined; casing the surface hole i if necessary, and cementing as known in the art to provide stability and to protect groundwater and resource leaching; drilling a hole at least partially through the resource body; inserting a mining pipe having at least two concentric circular rings or pipes with a jet nozzle and a slurry recovery system into the borehole. A high-pressure fluid pumping system is connected to the mining string and high-pressure fluid is pumped down one of more of the circular ring pipes and out of the jet nozzle at the cutting face. The high-pressure fluid stream interacts with the rock face down hole disaggregating the rock and putting the particles into a slurried suspension; this slurry is then recovered through the center bore of a circular ring piping system and returned to the surface, where the rock that is recovered will be processed and the mining fluid is recycled and used again in the process.

The mining system of the present invention mines hydraulically at significant depth at all angles from true vertical depth to a completely horizontal setting through a narrow diameter surface drilled hole in both atmospheric and in submerged conditions. High pressure mining fluid is conveyed through the circular ring system to the cutting jet nozzle down the hole. This interaction between the mining fluid and the target rock face disaggregates, slurrifies and returns it to the surface via specific return elements in the system.

This invention can be utilized to economically and efficiently mine resources that sit from 0 to 90 degrees from the vertical and may be utilized in resource bodies that are submerged or that are dewatered. The system utilizes a fluid that can either be clean water or clean water with polymer additive to increase the hydraulic horsepower to the rock face when the tool is utilized in a submerged or atmospheric environment.

The entire process occurs in a closed loop system beginning with the high-pressure fluid delivery elements extending from the surface down the borehole to the return elements back up into the surface processing facilities. The system further includes a sealed surface annulus connected to a pump that boosts the pressure on the annulus space, thereby aiding in the return of the slurry to the surface Thus arranged, the system maximizes effective hydraulic horsepower and fluid density properties by lamination of fluid flow through the circular pipe mining system down the well bore and though a tight radius turn of the jet stream.

The mining system of the present invention is designed to operate within the plane of the ore body that yields the greatest resource production at any angle from vertical to completely horizontal. The system is deployed either by directionally controlled drilling or vertically controlled stabilized drilling.

All of the elements of this mining system are designed to maximize fluid flow efficiency both down and up the wellbore. This fluid circulation with the laminar hydraulic jet stream and the return to surface using eduction and differential pressure allows a significant reduction in equipment, energy and costs compared to prior art hydraulic borehole mining systems, thus providing the minimization of economic and cost effective operating footprint and personnel prove to define commercial economics in multiple target ore types.

These and other advantages and novel features of the present invention will become apparent from the following description of the invention when considered in conjunction with the accompanying drawings.

BRIEF DESCRIPTION OF THE DRAWINGS

FIG. 6.B is a sectional view of the nozzle shown in FIG. 6.A;

FIG. 7.B is a side sectional view of the mining pipe shown in FIG. 7.A having portions removed to show the elements thereof in greater detail.

DETAILED DESCRIPTION OF THE INVENTION

Figure 1:
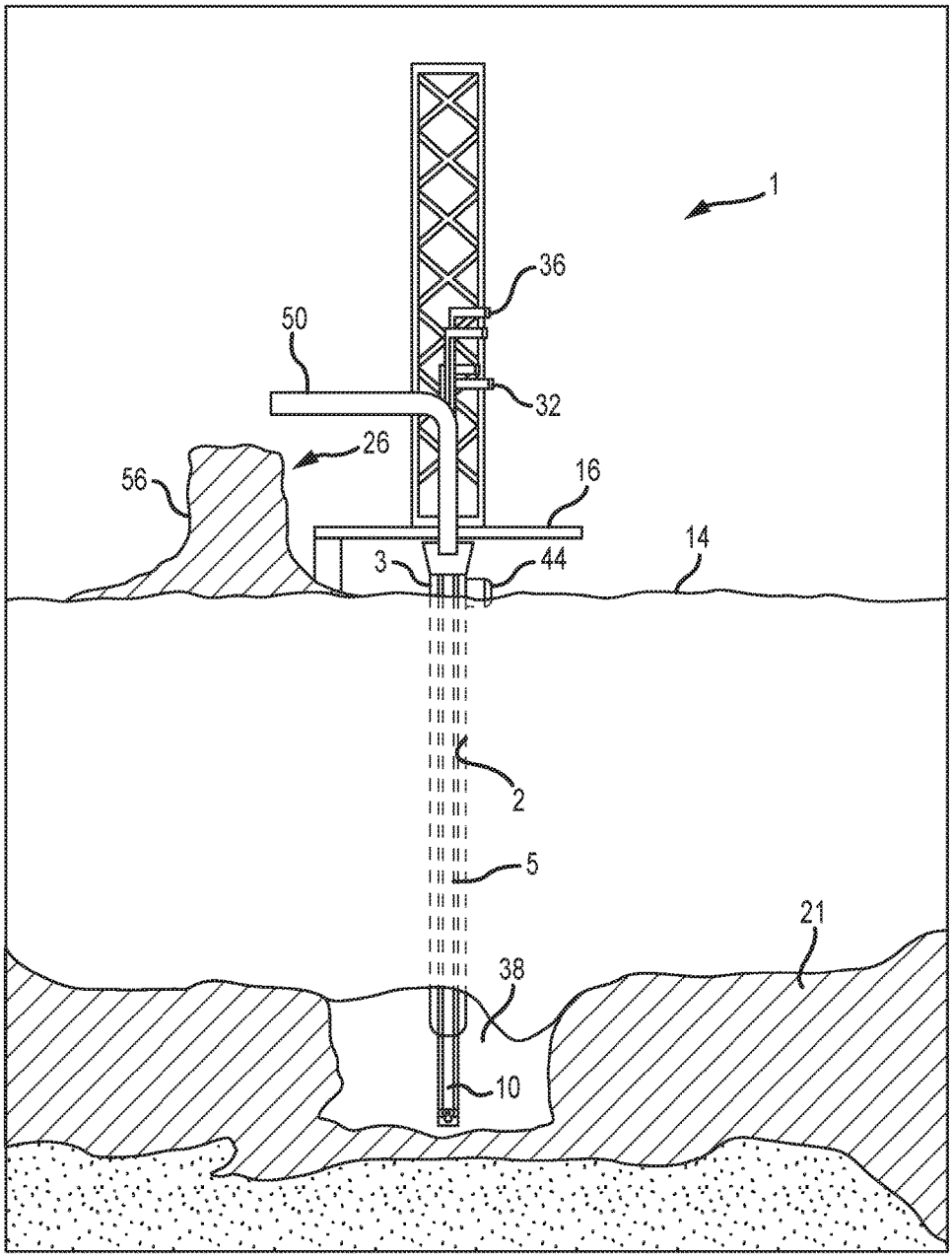
FIG. 1 is a general schematic of a hydraulic borehole mining system situated at a mining site in accordance with an embodiment.

Referring now to FIG. 1, a system and a process of hydraulic borehole mining for a subterranean resource in accordance with the present invention is described in detail. A rig shown generally at 1 is brought to the mining site, situated at a preferred location at the site, and operated to drill a well, wellbore or borehole, (as the terms are used in the art) 2 to the top of the resource body. The wellbore may be drilled at any angle from vertical to horizontal depending upon the geotechnical mining conditions down-hole and the structure of the ore body itself. If required, casing string, 3 is then run into the initial wellbore and cemented into position to give it strength. A conventional drilling string is then fed into the casing string, and a pilot hole is drilled at least partially into or through the resource body. The conventional drilling string (not shown) is thereafter removed from the hole.

Figure 2:
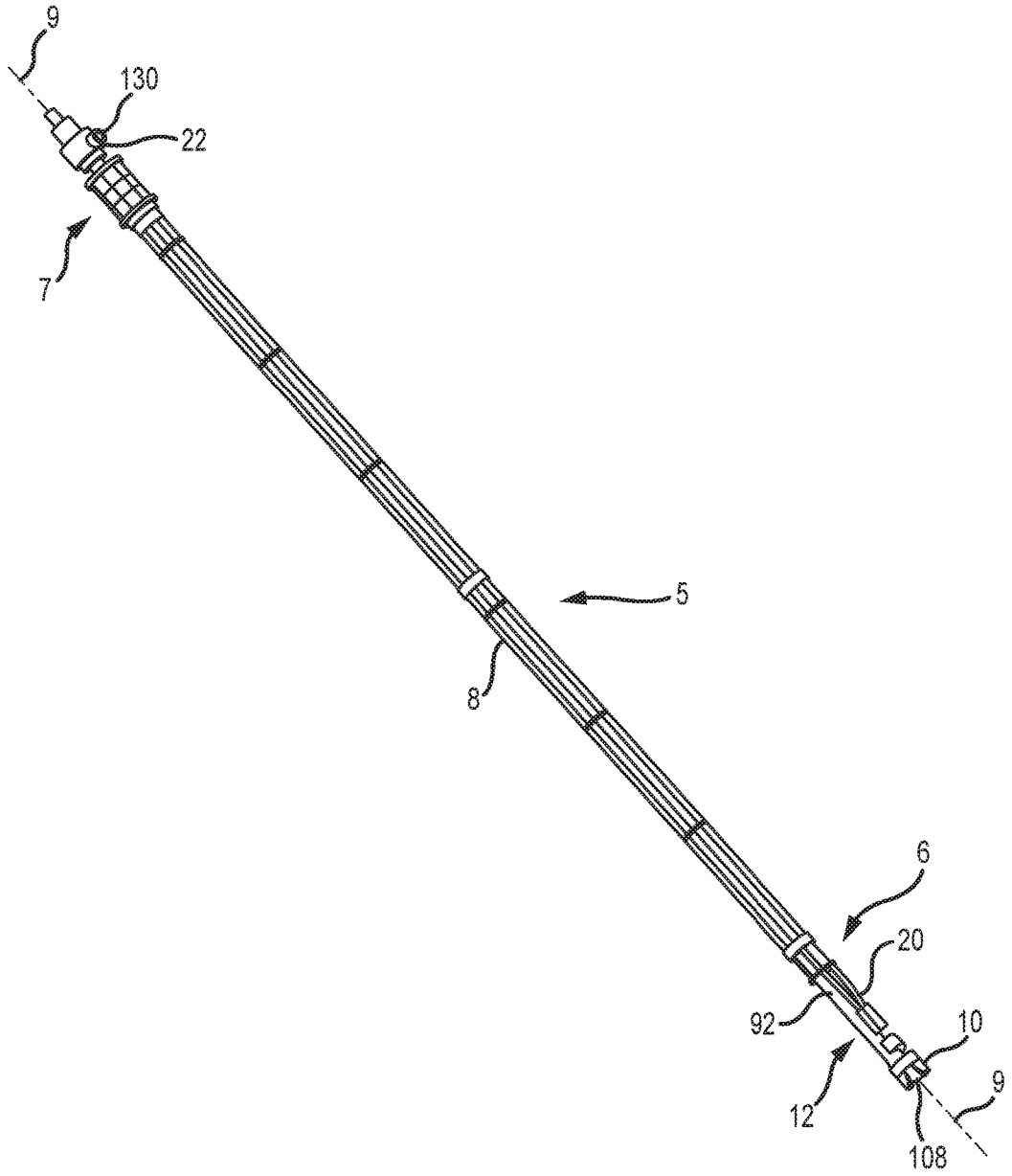
FIG. 2 is a side elevation view of the hydraulic borehole mining string of the system of FIG. 1.

Referring now to FIG. 2, a mining string 5 is illustrated in greater detail. The mining string is run into the wellbore and includes a bottom end 6, a top end 7, an elongate portion 8 extending co-axially along a longitudinal axis 9 thereof intermediate the top and bottom ends, and, an eductor bit 10 positioned at the bottom end of the string and attached to a high pressure monitor pipe 12. The monitor joint or pipe houses at least one quartic-straight jet nozzle 15 (FIGS. 6.A and 6.B) and a plurality of integrated laminar flow vanes within the high pressure monitor pipe 12 as will be described in greater detail below. The monitor pipe 12, is secured to the bottom end 6 of the mining string 5 that extends from the surface 14 and is operatively connected to a rig floor or platform 16 and associated surface equipment down to a subterranean resource deposit 21 (FIG. 1).

Figure 4:
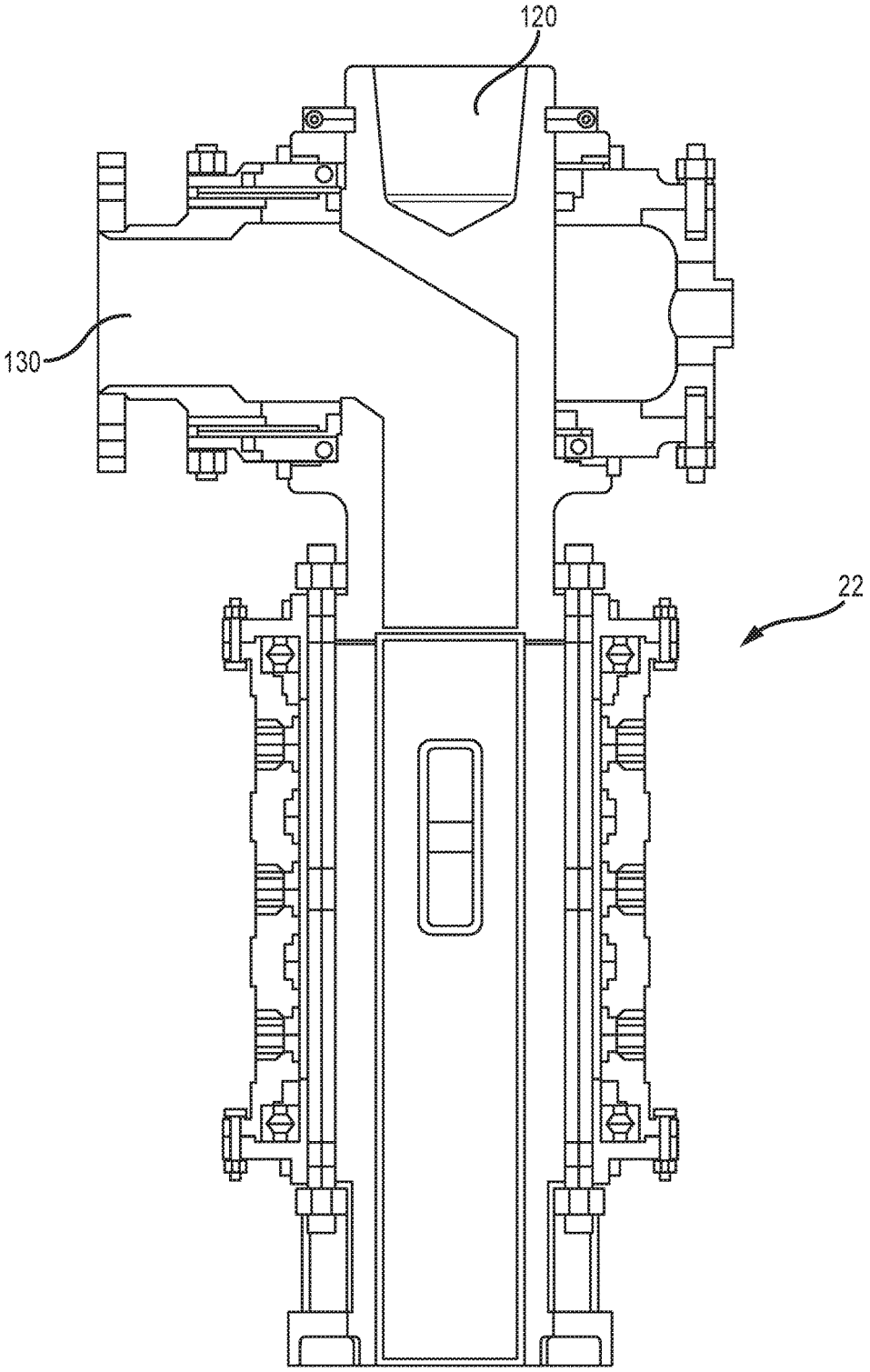
FIG. 4 is a sectional view of a low pressure and high pressure combination swivel in accordance with an embodiment.

The mining string includes a swivel 22 operatively connected to the top end 7 of the mining string. As shown in greater detail in FIG. 4, swivel 22, connects the mining string 5 via port 120 to the surface equipment providing air and high and low pressure water. As well be described in greater detail below, the swivel 22 consists of a combination of high pressure and low pressure fluid courses; the interconnections of which provide all of the fluid connections needed for the process. The swivel takes the high pressure feeds of water for the quartic-straight jet nozzle, the air to the air lift system, high and low pressure fluids for the eductor turns these fluids and air ninety degrees and sends them down the respective lines or annular concentric pipes in the mining pipe to the attachments down the string. The swivel 22 also provides a passageway or a return line 130 to conduct the slurry up the hole and to direct the slurry to one or more surface processing facilities, generally shown at 26 in FIG. 1. A unique and novel feature of the system of the present invention is the significantly enhanced ease of maintenance and efficiency of its operation as compared to any prior art systems and methods.

Figure 5:
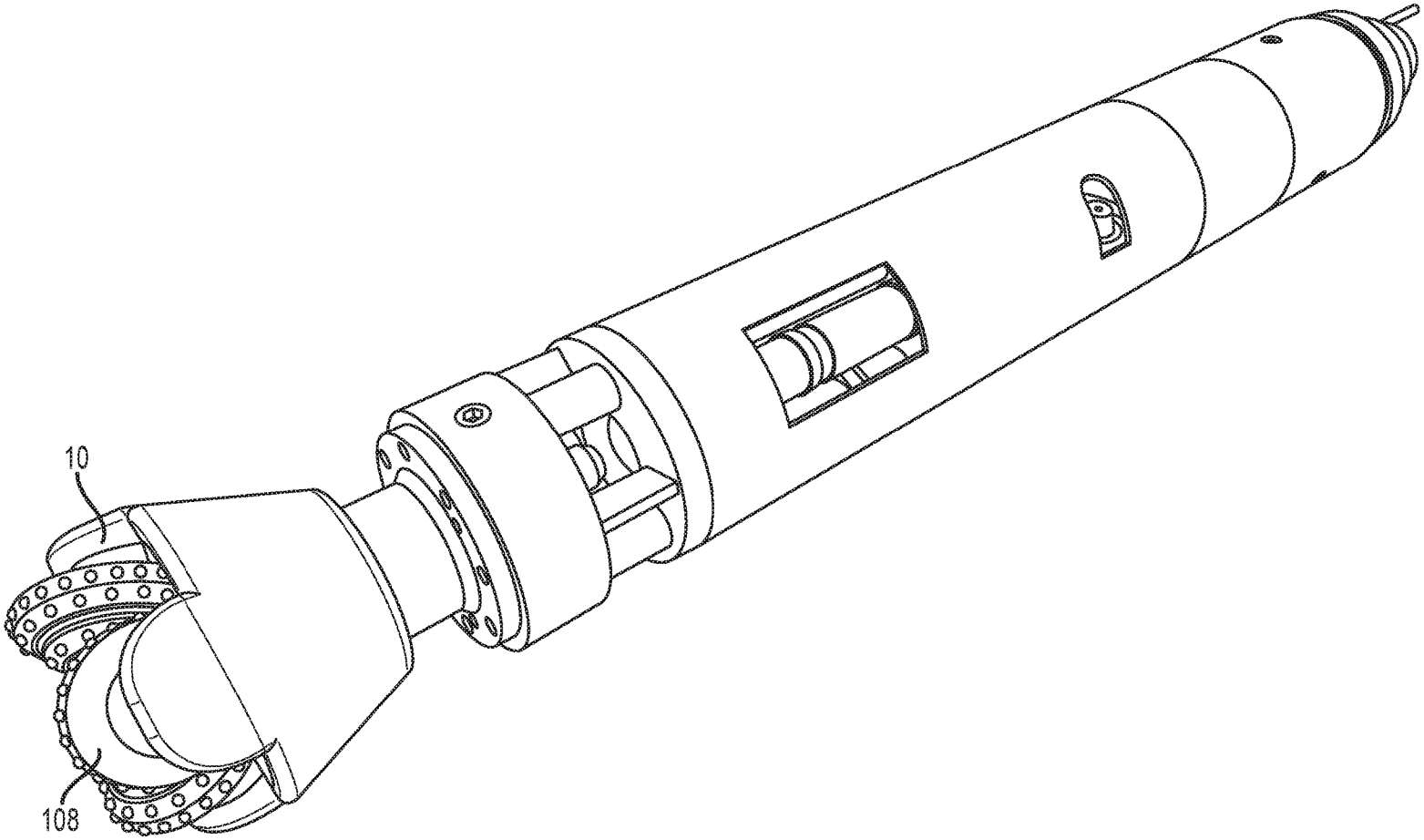
FIG. 5 is a side perspective view of the monitor subassembly with shielding and bit attached for hydraulic borehole mining applications in accordance with an embodiment.

Referring again to FIG. 1, the configuration of the surface portion of the mining system is illustrated in greater detail. The surface equipment includes high-pressure, high-volume jet mining pump(s) (not shown), which deliver water down hole via the swivel and high pressure line 32. An air compressor delivers air to the swivel via high pressure line 36 to be delivered down hole to an airlift assist line or pipe 19 (FIG. 5). A lower pressure water pump delivers water to the backside of the well head via low-pressure water line 44 to keep the surface hole full of water. The supply of low pressure water to the backside optionally may be forced in past a seal, introducing an additional amount of pressure and force to the backside of the pipe. This additional force above the weight of the column of water on the backside gives a boost to the recovery system by essentially forcing fluid under pressure up the mining string's lower density return line and thereafter to surface.

The return line 130 runs from the swivel to a dewatering system via a low-pressure slurry return line 50. This portion of the system removes the water from the resource and returns the water to a dirty water storage pond or tank (not shown). A storage facility 56 stores the dewatered resource while awaiting further processing by the mine. The water from the dewatering system then flows to a settling pond where any fines that have collected into the water are permitted to settle before flowing into a clean water storage area (not shown). The clean water storage area holds the clean water, which feeds all of the pumps.

The clean water is boosted into one or more high pressure pumps and then pressurized and pumped into the high pressure mining swivel 22 (FIG. 4) where it is turned 90 degrees and down the mining string 5 through the mining pipe. The pump(s) feeds the mining pipe line via high-pressure line inlet 32. The line is connected to the swivel 22 and then runs the length of the pipe via one ring 96 of the concentric annular triple wall mining pipes illustrated in greater detail in FIGS. 7.A and 7.A.

Figure 3:
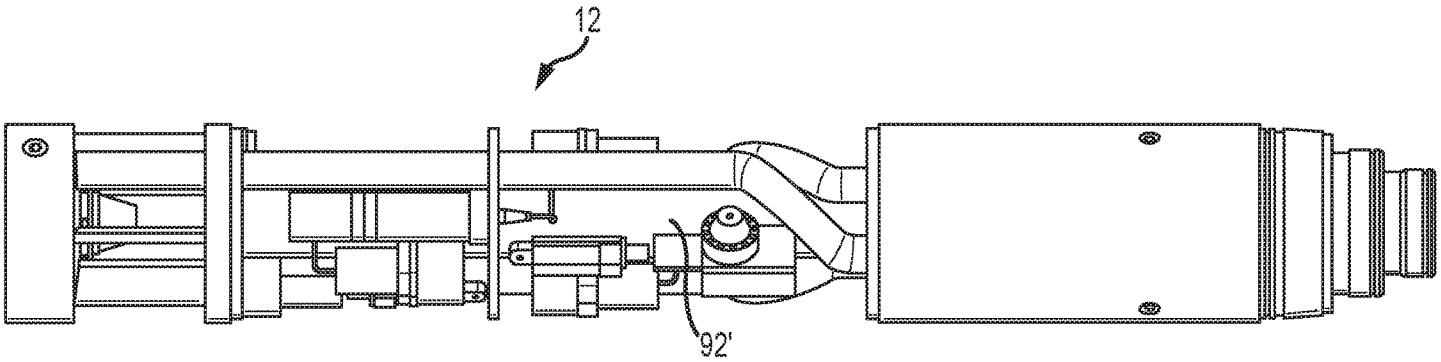
FIG. 3 is a side partial sectional view of a monitor subassembly for the hydraulic borehole mining string of FIG. 2 having shielding portions removed to show the elements thereof in greater detail.
Figure 7A:
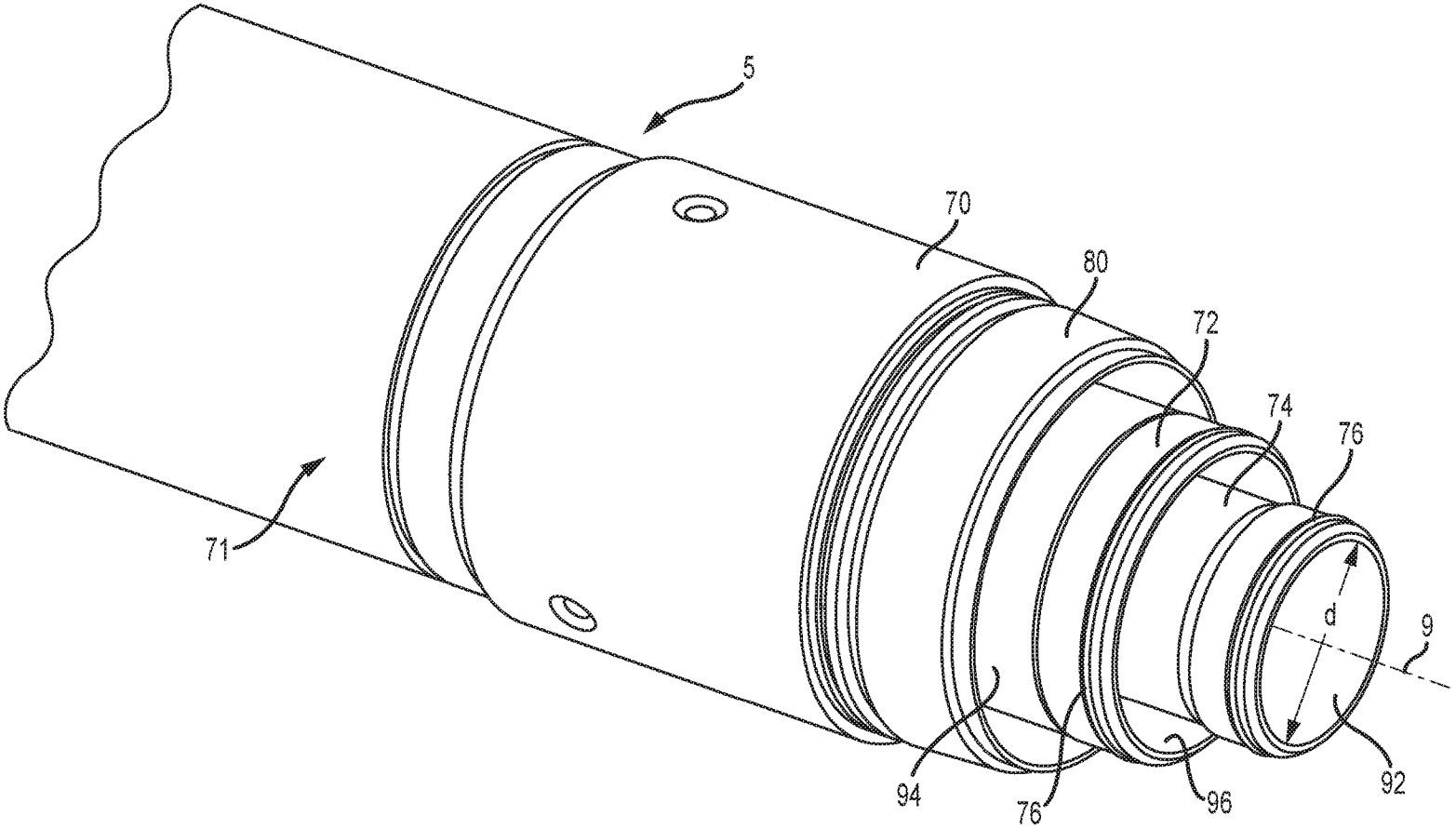
FIG. 7.A is a side perspective view of a mining pipe in accordance with an embodiment.
Figure 7B:
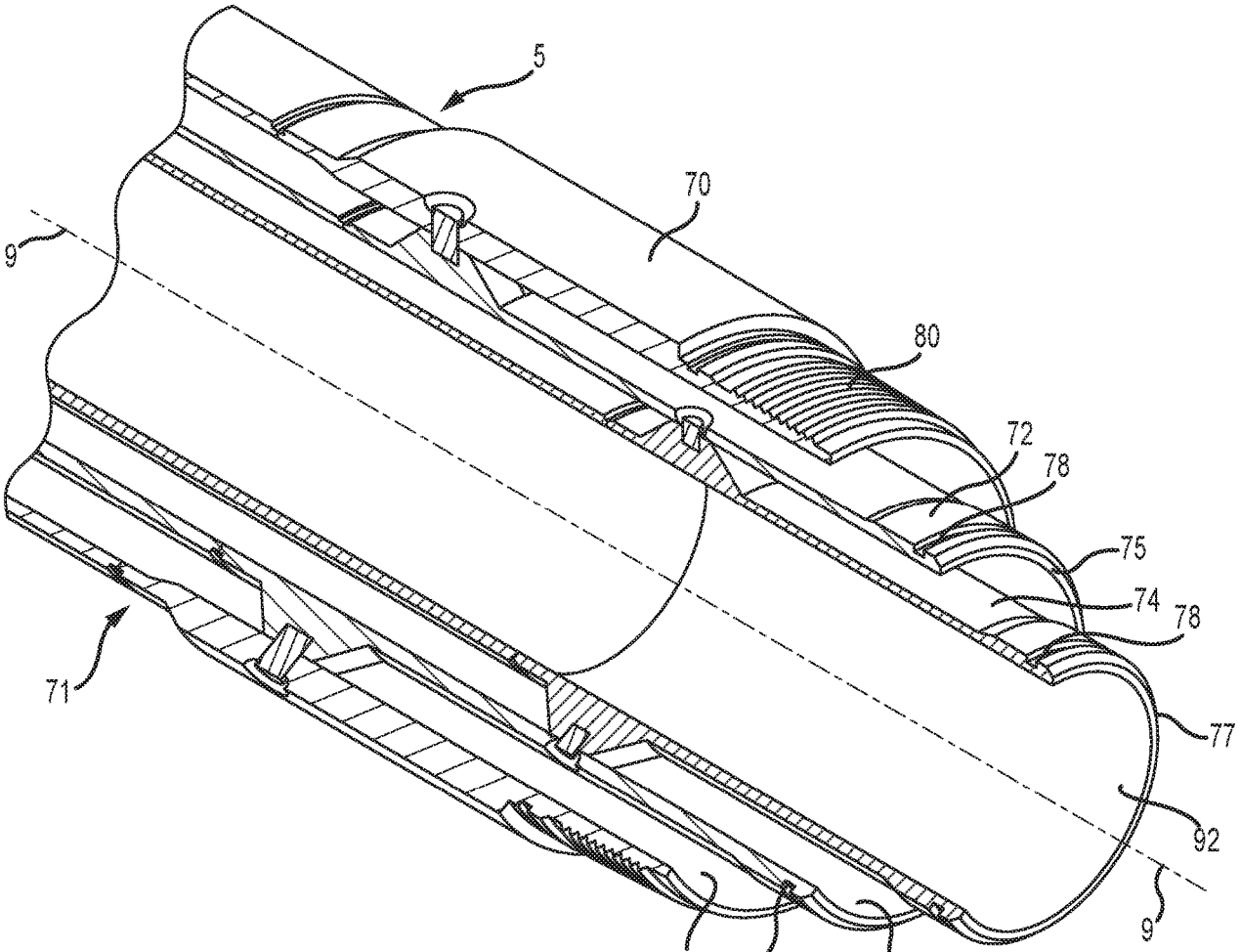

Referring now to FIGS. 7.A and 7.B, the elements of the mining string 5 are shown in greater detail. In the embodiment shown, by way of example and not of limitation, the string includes three elongate cylindrical tubes or pipes (also referred to in the art as "subs"), 70, 72 and 74, of selectively decreasing diameter, d, with respect to an outer surface 71 of the mining string (only one of which diameters is shown) concentrically disposed about and extending substantially parallel with one another along a longitudinal axis 9. The inner most pipe 70 forms a center return line or bore 92 for returning the slurry to the surface. Tube 70 cooperates with tube 72 to form an outside annular ring or pipe 94, and tube 72 cooperates with tube 74 to form an annular ring or pipe 96 extending circumferentially around the bore 92; the bore 92 and the annular rings 94 and 96 being concentric with one another. The interconnections between progressive adjoining sections of the mining string 5 utilize full flow concentric connections at each joint to provide a high pressure seal between each inner concentric mining pipe sections 72 and 74 and an adjoining section (not shown) via special high pressure, expandable O-rings 76 (FIG. 7.A) seated in grooves 78 formed in a first end 75, 71 of each of the concentric pipes 72, 74 respectively (FIG. 7.B). The end of each of the subs fits inside a corresponding mating flange (not shown) on a second end of each of the concentric pipes. This novel configuration allows for the full inside diameter (internally flush) of the concentric lines of the mining pipe to be maintained in a concentric relationship with one another to the connection sub. The connection subs are utilized in the connection of the individual segments of the entire mining pipe string 5 (FIG. 2) and the connection of the monitor pipe 12 (FIG. 3). Due to the internally flush-full bore, restriction-free structure of the subs, the pressure drop in the concentric high pressure rings at the connections is substantially reduced over prior art systems, an advantage which manifests itself over a large number of connections in a string, where the pressure drop over the overall distance would be significant. Moreover, the threaded connections found in prior art system, which are subject to galling are eliminated in the internal portions, thereby significantly reducing system downtime and extending the useful life of the mining string. Only the external pipe 70 includes a male threaded end 80, which is adapted to be threadably connected to a corresponding female threaded end of an adjacent section.

As shown in FIGS. 3 and 5, the monitor joint or pipe 12 includes a first section or portion 13 which contains laminar flow vanes positioned perpendicular to one another and which are structured and arranged to create and maintain a laminar flow of the mining fluid. The monitor includes laminar vanes (not shown) which are adapted to preliminarily align the otherwise turbid flow of the water into a laminar flow stream configuration, thereby providing increased hydraulic horsepower to the jet stream. As noted above, the laminar flow is established utilizing the vanes to split and align the flow. The vanes are formed of a suitable material such as steel and are positioned securely in the monitor.

Figure 6A:
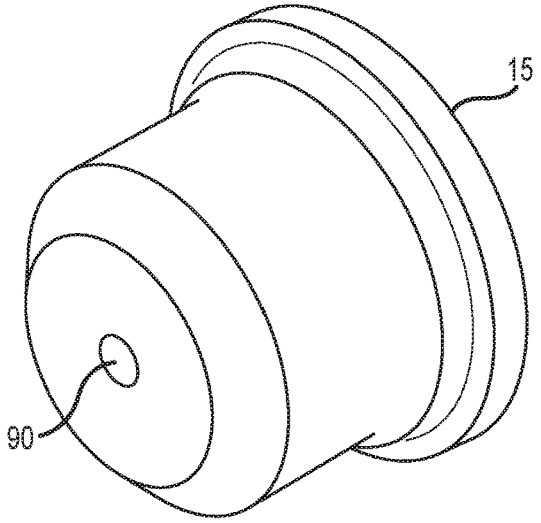
FIG. 6.A is a side perspective view of a quartic straight nozzle in accordance with an embodiment.
Figure 6B:
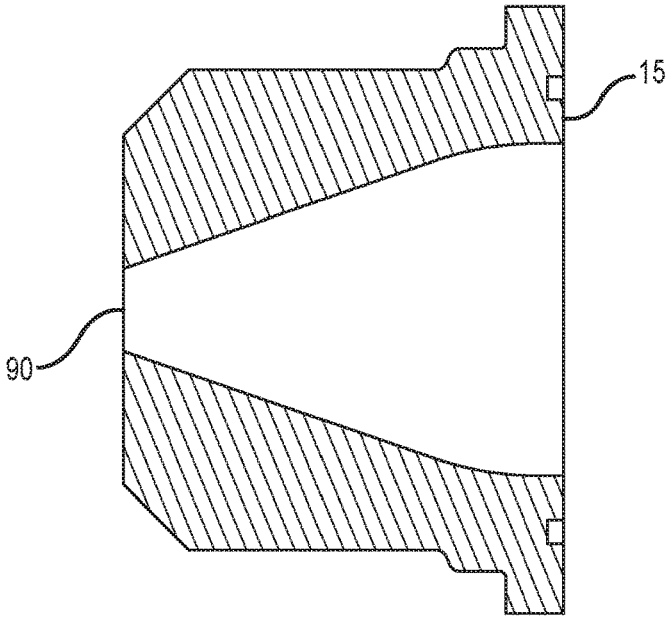

Referring to FIG. 3, and, as shown in greater detail in FIG. 7.A., the annular high pressure water rings 94, 96 of the mining pipe feed the water flow to the monitor pipe 12 where the water becomes laminar, thus ensuring that laminar flow is maintained while the water is joined to and then forced through the monitor 12. In an embodiment, the high pressure water flow may be limited to only the inner annular ring or pipe 96, the outer annular ring 94 serving to deliver low pressure water and also as a safeguard against any high pressure leakages. The monitor maintains the water flow in a laminar stream without introducing turbidity into a second section or portion 17 which is in fluid communication with the first section 13 and then turns the water flow into at least one quartic-straight jet nozzle 15 (FIGS. 6.A and 6.B). As a result, more water at a higher velocity can be provided through the system because of the continuation of the laminar flow. The quartic-straight jet nozzle delivers the laminar flow into a focused jet through a nozzle orifice 90 delivering a high pressure, high volume stream of fluid at supersonic velocity into the rock face.

As the water jet impacts the rock face it begins to disaggregate the material. The disaggregated material mixes with the water creating a slurry stream which is then carried to the eductor bit 10 as shown in FIGS. 2 and 5. The eductor bit pushes the slurry stream up a slurry return pipe 92 in the monitor 12 which is connected to the slurry return pipe 92' in the mining string, whereupon it is accelerated by a vacuum created in the return pipe 92 by the combination of airlift assist and the pressure applied to the outside of the mining string 5, in part via the low pressure water line 44 as described above. This vacuum is created in two unique ways. First, the airlift assist is charged by air from a compressor and is carried through the mining pipe via an airlift assist line 19 that runs inside the internal slurry return pipe 92 where it terminates at the ideal airlift placement, depending on conditions, typically at a depth of approximately 200 feet. The air then escapes through the open ended pipe within the slurry return 92 via the airlift entry point. The tiny bubbles that are introduced at depth expand as they move up the slurry return line. The bubble expansion lowers the density in the slurry return line which causes a u-tube effect on the outside of the mining string, and fluid moves through an eductor bit opening 108 and into the mining pipe slurry return line. This suction recovers the slurry created by the quartic-straight jet nozzle 15 and the disaggregated ore.

The airlift assist line 19 is typically placed at depth in a vertical well at a level to maximize the lift of slurry. This depth is adjusted according to the type of resource being mined. For instance, when mining Kimberlites, the depth of the airlift sub in the well is controlled closely to keep velocities of the resource lower to limit diamond breakage. For mining uranium, on the other hand, an example of ore where grain size after cutting is not monitored, the airlift assist line is placed lower in the well to increase the tonnage/mining rate per hour. On horizontal wells the airlift release is generally within the vertical section of the well for lift, and the eductor pushes the cut ore through the horizontal section. Critical velocities are matched to each ore type and the direction of the well to ensure the slurry is maintained in suspension without erosion of the system. The airlift assist is a significant improvement over previous systems that only incorporate a fluid eductor for the recovery of the slurry, inasmuch as the airlift assist reduces the total amount of horsepower that is needed on location to drive the system. It is through this reduction of horsepower that a significant reduction of overall capital costs is attained, not only by eliminating an additional pump, but also by reducing the overall cost of the operating expenses as a result of the lower horsepower demands.

The second part of the slurry return system and a key element of the system and method of the present invention is the eductor bit 10 discussed above with reference to FIG. 2. The eductor bit is operated with relatively low pressure and with a high volume stream of water. This water stream is selectively delivered through one of the concentric rings 94, 96 in the mining pipe 5. This water is delivered to the monitor pipe which houses the eductor assembly and turned 180 degrees via a conduit and directed back up the inner bore or slurry return line 92 of the mining string 5. The water flow creates a suction that draws slurry into the eductor and forces it up the hole.

The slurry passes through a narrower gauge 92' of pipe within the eductor housing while being simultaneously boosted through that section of the eductor with the clean water from the surface via the outside concentric ring 94. The acceleration of the fluids through the narrow section and then up the slightly larger inner bore of slurry return line 92 of the mining pipe causes a vortex and, effectively, a vacuum on the down hole side of the eductor. The two fluid streams converging in the narrow body of the eductor accelerate and then are released into the larger return pipe diameter. The differential pressure does not allow the fluid out the bottom of the bit, so it accelerates the flow up the well bore continuously. The slurry is then carried up the hole, through the swivel 22 and through and out of the swivel 22, via return line 130 where it is sent to the surface dewatering facility 26 via a slurry return pipe 50 (FIG. 1).

Each resource type dictates the specific mining strategy utilized. The formation of the mined cavity can be by drilling a pilot ahead and through the resource body and starting at the bottom of the hole and mining up or back towards the rig in the case of a horizontal well, or starting at the top of resource body and utilizing the eductor bit of the present invention to drill and mine at the same time from the top down. The competency of the formation of the target resource and the geotechnical parameters surrounding it dictates the mining approach and strategy. In either direction, the cavity is developed through the disaggregation action of the hydraulic jet and the rotation of the mining string. The string is rotated at a preselected rotational speed, by a rotation apparatus operatively connected thereto, for example, an electrical motor coupled to the string via a gear mechanism or the like, the speed of rotation being determined by the competency of the formation and the distance or length of the cut at any given point within the resource body. The jet is rotated sufficiently slowly to allow enough effective interaction between the hydraulic jet and the rock face to perform the disaggregation and the slurrification of the resource. The rotational speed is determined by the amount of material that is returned and sent through the dewatering facilities. The time on the ore face coupled with the combination of flow and pressure is adjusted to maximize production. As the mining string is slowly rotated, a larger and larger cavity is created. This cavity in a vertical application can be a full 360 degree circle or pillars can be left in place to support the surrounding resource as the cavity is cut. As the returns diminish, the tool string is moved vertically and another rotational pass is made. This basic technique is continued until the desired cavity is cut from the targeted zone. Several times during the process, the mining string can be dropped to the bottom and the suction system can be used to remove any slurrified material that passed the mining string and fell to the bottom of the hole. Dependent on the resource being cut polymer can be added to the jet stream to increase the effective hydraulic horsepower at the ore face, which increases the cutting distance of the tool. The entire cutting process is repeated to enlarge the cavity. Upon completion of the cavity mining the entire mining string is removed from the borehole.

When the hydraulic borehole mining is performed in a high angle or horizontal application, the technique used to create the cavity can be different than that of the vertical application. In a horizontal application, the system of the instant invention is ideally drilled and directed to the bottom of the targeted resource. A pilot hole will be drilled from the surface to the bottom of the targeted resource body and then horizontally out as far as reasonably possible into the formation. on the depth of the horizontal hole depends upon the characteristics of the formation material. The hole will be drilled out as far as possible without collapsing on top of the tool string. The drilling string will be removed and replaced with the mining string of the present invention. The mining system will be run out in the lateral direction to the end of the hole. Thereafter, the jet will be turned on. In the horizontal application, the monitor pipe will be rotated no more than 180 degrees. Since the tool is on the bottom of the resource zone, the targeted areas will be to the side and the top of the monitor pipe. In thicker resource zones, one lateral well can be mined above the other. If the competency of the resource body is low, then the monitor pipe can be manipulated to perform 60-degree sweeps to either side of the tool, thereby making a bowtie pattern in the resource body. The advantage to this pattern in a low competency formation is that it permits recovery of the resource on the sides, which is facilitated by the natural subsidence of the formation over the mining string. As a section of the cavity is excavated, the mining string is slowly extracted, making the cavity larger and longer as the tool is retracted into the surface casing string. Upon completion of the cavity the mining system is removed from the hole.

Although the present invention has been described with reference to a particular embodiment thereof, it will be understood by those skilled in the art that modifications may be made without departing from the scope of the invention. Accordingly, all modifications and equivalents which are properly within the scope of the appended claims are included in the present invention.

What is claimed is:

1. A borehole mining system situated on a surface at a mining site for continuous in situ mining of a subterranean resource, comprising:

a mining rig positioned in situ on the surface;

a mining string operatively connected to the rig and being positioned in a borehole extending from the surface through any overburden intermediate the surface and the subterranean resource and into the subterranean resource; the mining string including one or more mining pipe sections operatively connected to one another, each mining pipe section including a plurality of passages extending therethrough adapted to direct preselected fluids and gases from the surface through the mining string to the subterranean resource; at least one of the passages being a high pressure passage adapted to deliver high pressure mining fluid through the system;

a monitor pipe assembly operatively connected to a bottommost mining pipe section of the string, the monitor assembly having a first section which is structured and arranged to receive the high pressure mining fluid and to create laminar flow thereof, a second section in fluid communication with the first section, the second section being adapted to maintain and redirect the laminar flow of high pressure mining fluid;

a nozzle apparatus adapted to receive the redirected laminar flow of high pressure mining fluid, the nozzle apparatus including a nozzle orifice structured and arranged to form and deliver to the subterranean resource a high pressure, high volume stream of laminar mining fluid at supersonic velocity, whereby a slurry of disaggregated subterranean resource material and mining fluid is created;

an eductor apparatus adapted to transport the slurry from the in situ position of the subterranean resource via a slurry return line in the monitor pipe and mining string to the surface; and an airlift system adapted to form a vacuum in the return line, whereby the transport of the slurry to the surface is accelerated.

2. The mining system of claim 1 wherein each of the one or more mining pipe sections includes a longitudinal axis, at least two elongate cylindrical tubes of selectively decreasing diameters with respect to an outer surface of the mining string concentrically disposed about and extending substantially parallel with one another along the longitudinal axis.

3. The mining system of claim 2 wherein the innermost of the at least two cylindrical tubes forms a center return line structured and arranged to return the slurry to the surface.

4. The mining system of claim 3 wherein the at least two elongate cylindrical tubes cooperate with one another to form an annular tube extending circumferentially around the center return line.

5. The mining system of claim 4 wherein the annular tube extending circumferentially around the center return line is adapted to deliver high pressure fluid to the monitor pipe assembly.

6. The mining system of claim 5 further including a third elongate cylindrical tube having a diameter greater than each of the at least two cylindrical tubes, the third elongate cylindrical tube being concentrically disposed about and extending substantially parallel with the at least two cylindrical tubes of lesser diameter along the longitudinal axis.

7. The mining system of claim 6 wherein the third cylindrical tube and the outermost of the at least two cylindrical tubes cooperate with one another to form an outside annular tube, the outside annular tube being concentrically disposed about and extending substantially parallel with the at least two cylindrical tubes along the longitudinal axis.

8. The mining system of claim 7 wherein the outside annular tube is adapted to deliver either high or low pressure fluid to the monitor pipe assembly.

9. The mining system of claim 2 wherein each of the at least two cylindrical tubes includes a first end portion and a second end portion, each first end portion having a groove formed therein extending circumferentially around the end portion, each groove being structured and arranged to receive a high-pressure expandable O-ring therein which fits inside a corresponding mating flange formed on the second end portion of each of the at least two cylindrical tubes, each of the O-rings and corresponding mating flanges cooperating with one another to form full flow concentric connections between progressive adjoining sections of the mining string.

10. The mining system of claim 1 wherein the eductor apparatus includes an eductor bit operatively connected to the monitor pipe assembly, the eductor bit being structured and arranged to push the slurry up into the slurry return line.

11. The mining system of claim 1 wherein the airlift system includes an air line extending from the surface down into the inside of the slurry return line to a preselected depth, the depth being responsive to the properties of the subterranean resource being mined.

12. The mining system of claim 1 further including an apparatus for controllably rotating the mining string in the borehole.

13. A borehole mining system situated on a surface at a mining site for in situ mining of a subterranean resource, comprising:

a mining rig positioned in situ on the surface;

a mining string operatively connected to the rig and being positioned in a borehole extending from the surface through any overburden intermediate the surface and the subterranean resource and into the subterranean resource; the mining string including one or more mining pipe sections operatively connected to one another, each mining pipe section including a longitudinal axis, at least two elongate cylindrical tubes of selectively decreasing diameters with respect to an outer surface of the mining string concentrically disposed about and extending substantially parallel with one another along the longitudinal axis, the innermost of the at least two cylindrical tubes forming a center return line structured and arranged to return the slurry to the surface, the at least two elongate cylindrical tubes cooperating with one another to form an annular tube extending circumferentially around the center return line, the annular tube being adapted to deliver high pressure fluid to the monitor pipe assembly; each mining section further including a plurality of passages extending therethrough adapted to direct preselected fluids and gases from the surface through the mining string to the subterranean resource; at least one of the passages being a high pressure passage adapted to deliver high pressure mining fluid through the system, and a third elongate cylindrical tube having a diameter greater than each of the at least two cylindrical tubes, the third elongate cylindrical tube being concentrically disposed about and extending substantially parallel with the at least two cylindrical tubes of lesser diameter along the longitudinal axis;

a monitor pipe assembly operatively connected to a bottommost mining pipe section of the string, the monitor assembly having a first section which is structured and arranged to receive the high pressure mining fluid and to create laminar flow thereof, a second section in fluid communication with the first section, the second section being adapted to maintain and redirect the laminar flow of high pressure mining fluid;

a nozzle apparatus adapted to receive the redirected laminar flow of high pressure mining fluid, the nozzle apparatus including a nozzle orifice structured and arranged to form and deliver to the subterranean resource a high pressure, high volume stream of laminar mining fluid at supersonic velocity, whereby a slurry of disaggregated subterranean resource material and mining fluid is created;

an eductor apparatus adapted to transport the slurry from the in situ position of the subterranean resource via a slurry return line in the monitor pipe and mining string to the surface; and an airlift assist line extending from the surface down into the inside of the slurry return line to a preselected depth, the depth being responsive to the properties of the subterranean resource being mined.

14. The mining system of claim 13 wherein the third cylindrical tube and the outermost of the at least two cylindrical tubes cooperate with one another to form an outside annular tube, the outside annular tube being concentrically disposed about and extending substantially parallel with the at least two cylindrical tubes along the longitudinal axis.

15. The mining system of claim 14 wherein the outside annular tube is adapted to deliver either high or low pressure fluid to the monitor pipe assembly.

16. The mining system of claim 13 wherein each of the at least two cylindrical tubes includes a first end portion and a second end portion, each first end portion having a groove formed therein extending circumferentially around the end portion, each groove being structured and arranged to receive a high-pressure expandable O-ring therein which fits inside a corresponding mating flange formed on the second end portion of each of the at least two cylindrical tubes, each of the O-rings and corresponding mating flanges cooperating with one another to form full flow concentric connections between progressive adjoining sections of the mining string.

17. The mining system of claim 13 wherein the eductor apparatus includes an eductor bit operatively connected to the monitor pipe assembly, the eductor bit being structured and arranged to push the slurry up into the slurry return line.

18. The mining system of claim 13 further including an apparatus for controllably rotating the mining string in the borehole.

* * * * *